United States Patent [19]

Blackburn et al.

[11] 4,387,490

[45] Jun. 14, 1983

[54] BUCKLES

[75] Inventors: Neil P. Blackburn, Winchester; Alfred E. C. Piper; Alan M. G. Meeks, both of Basingstoke, all of England

[73] Assignee: ITW Limited, Berkshire, England

[21] Appl. No.: 282,983

[22] Filed: Jul. 14, 1981

[30] Foreign Application Priority Data

Jul. 15, 1980 [GB] United Kingdom ..... 8023033

[51] Int. Cl.[3] ..... A44B 11/02; A44B 11/20

[52] U.S. Cl. ..... 24/200; 24/198; 24/265

[58] Field of Search ..... 24/265 A, 200, 265 R, 24/265 BC, 265 EE, 198, 186; 2/321, 322

[56] References Cited

U.S. PATENT DOCUMENTS

| | | | |
|---|---|---|---|
| 207,694 | 9/1878 | Tunny | 24/265 A |
| 518,681 | 4/1894 | Tyler | 24/265 A |
| 1,454,783 | 5/1923 | Yettier | 24/265 A |
| 1,868,867 | 7/1932 | Anderson et al. | 24/265 A |
| 2,129,872 | 9/1938 | Reiter | 24/265 A |
| 2,896,294 | 7/1959 | Cheney | 24/265 A |
| 3,162,916 | 12/1964 | McHugh, Jr. | 24/198 |
| 3,192,588 | 7/1965 | White | 24/200 |
| 3,414,943 | 12/1968 | Hattori | 24/200 |
| 3,448,464 | 6/1969 | Jonas | 24/265 A |

FOREIGN PATENT DOCUMENTS

| | | | |
|---|---|---|---|
| 4668 | 6/1896 | Norway | 24/198 |
| 501719 | 3/1939 | United Kingdom | 24/265 A |
| 1269858 | 4/1972 | United Kingdom | 24/186 |

*Primary Examiner*—Paul J. Hirsch

*Attorney, Agent, or Firm*—Trexler, Bushnell & Wolters, Ltd.

[57] ABSTRACT

A one-piece plastics moulding includes a pair of flaps 12*a,* 12*b* connected by a hinge 14. Both of the flaps 12*a,* 12*b* are slotted so that, when they are folded about the hinge 14 to their closed position, a pair of parallel bars 22, 24 is presented for use in adjustably securing a strap 20. Both of the flaps 12*a,* 12*b* have spikes 54, 56 for use in trapping a web-like workpiece 48. Any parts of the buckle 10 which touch, such as free ends of the spikes 56 located in complementary apertures 52, can be fixed together by ultrasonic welding, heat sealing or adhesive.

4 Claims, 3 Drawing Figures

BUCKLES

The present invention relates to buckles for use in adjustably securing a strap in such a manner that, with the buckle in a working position, lengthwise movement of the strap relative to the buckle is strongly resisted in one direction but not in the opposite direction, whereas with the buckle in a releasing position the strap is freely movable in either direction.

Normally, the direction in which lengthwise movement of the strap is strongly resisted is that which would result in a loosening of the strap, with the opposite direction then corresponding to a tightening of the strap.

An example of the many applications in which such a buckle is useful is as a fastening on a life jacket, where it is important that the life jacket can be quickly secured by tightening the strap, yet can be removed only after the buckle has been positively moved from its working position to its releasing position.

The required manner of operation can be achieved by forming the buckle with a pair of parallel bars, which lie transversely to the strap and are spaced apart from one another.

In assembly, a free end of the strap is caused to approach the buckle in the plane of the bars. It is convenient to refer to the initially nearer of the two bars as the first bar and to refer to the other bar as the second bar. The free end of the strap is then sequentially passed beneath (or above) the first and second bars, wrapped around the second bar, threaded from above (or below) through the space between the first and second bars, and finally passed again beneath (or above) the first bar. It will be appreciated that the free end of the strap is now sandwiched between the first bar and a portion of the remaining length of the strap.

In use, tightening the strap by pulling said free end of the strap is relatively easy in comparison to attempting to loosen the strap by pulling said remaining length of the strap. To release the strap, the buckle must be turned about the axis of the second bar so that the first bar is moved away from said remaining length of the strap. The tighter the strap, the more firmly the buckle is held in its working position, and thus the more force needed to be applied to the buckle to turn it to its releasing position.

Altering the shapes and the positions of the bars will naturally affect the ease of adjusting the strap and releasing the buckle and particularly preferred shapes and positions of the bars are those disclosed in British patent publication No. 2 020 729 A in the name of our parent company Illinois Tool Works Inc.

Although there have been considerable advances in the design of the bars of the buckle for adjustably securing the strap, as exemplified by the above-identified patent publication, there have not been any significant advances in the manner by which the buckle is to be itself fixedly secured either to the other free end of a strap, or to a sheet of fabric such as part of a rucksack or a life jacket.

The buckle is conventionally provided with an opening, which allows the other free end of a strap to be looped around part of the buckle and to be then fastened to itself by for example stitching, or which allows a separate short strap to be similarly fastened at one end to the buckle, the other end of the short strap then being again fastened by for example stitching to a sheet of fabric.

An important aim of the present invention has been to obviate this conventional requirement for a stitching operation.

In accordance with the present invention, a buckle comprises a one-piece plastics moulding including a pair of flaps connected by a hinge, one or both of the flaps being so slotted that, at least when the flaps are folded about the hinge to a closed position thereof for use in trapping a web-like workpiece, a parallel bar arrangement is presented for use in adjustably securing a strap.

To ensure that the workpiece is firmly secured to the buckle, at least one and preferably both of the flaps has workpiece gripping means.

The workpiece gripping means may include coatings of heat-sensitive or pressure-sensitive adhesive on those faces of the flaps which are to contact the workpiece. Alternatively, or additionally, the workpiece gripping means may include a plurality of spikes. Free ends of at least some of the spikes formed on one of the flaps may be locatable within complementary apertures formed in the other of the flaps. Indeed, both of the flaps may have workpiece gripping means in the form of a plurality of spikes, the spikes formed on one of the flaps being longer than the spikes formed on the other of the flaps, free ends of the spikes formed on said one of the flaps being locatable within complementary apertures formed in said other of the flaps, and the spikes formed on said other of the flaps being distributed in symmetrical groups about each of the complementary apertures. The free ends of said longer spikes could then be upset, ultrasonically welded, heat sealed, glued, or even arranged to snap engage, into said apertures.

Generally, any parts of the buckle which are in contact, in the closed position of the flaps, can be readily fixed together by adhesive, ultrasonic welding, or heat sealing.

Preferably, each of the flaps is slotted in a first region so that the parallel bar arrangement, for use in adjustably securing a strap, is presented only in the closed position of the flaps. Although the hinge can have other locations, it is particularly convenient if the hinge extends directly between said first regions of the flaps, the hinge itself lying parallel to said parallel bar arrangement. The workpiece is then to be trapped between second regions of the flaps, further from the hinge than said first regions, said second regions preferably being relieved to accommodate the thickness of the workpiece to be trapped. To help avoid unintentional release of the strap, the parallel bar arrangement preferably defines a gap through which the strap is to pass, the gap being narrower than the thickness of the strap, when viewed in a direction substantially perpendicular to the parallel bar arrangement, so that the strap is caused to be reversely inclined.

Typically the web-like workpiece to which the buckle is to be firmly secured, but without the conventional requirement for a stitching operation, will as discussed hereinabove be a free end of a strap, or a sheet of fabric.

A buckle according to the present invention will now be described, by way of example only, with reference to the accompanying drawings, in which.

The accompanying drawings show a buckle 10 according to the present invention which is moulded in one-piece of a plastics material such as nylon 6.6.

Figure 1:
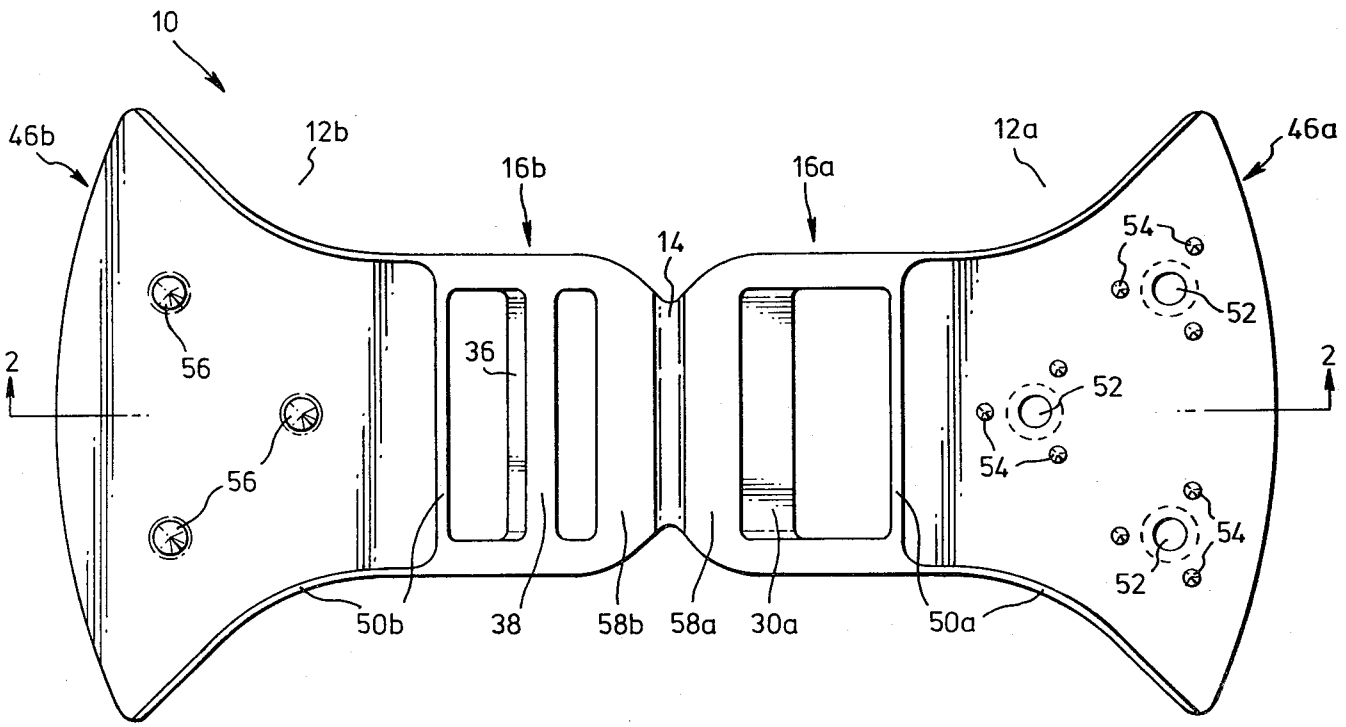
FIG. 1 is a plan view of the buckle in its as-moulded condition.
Figure 2:
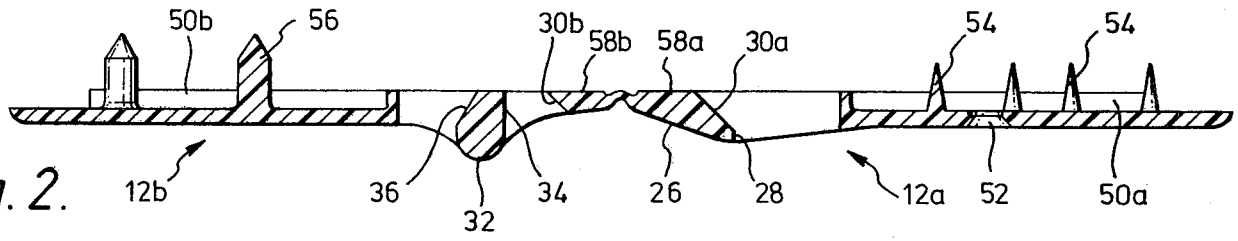
FIG. 2 is a cross-section taken along the line 2—2 of FIG. 1.
Figure 3:
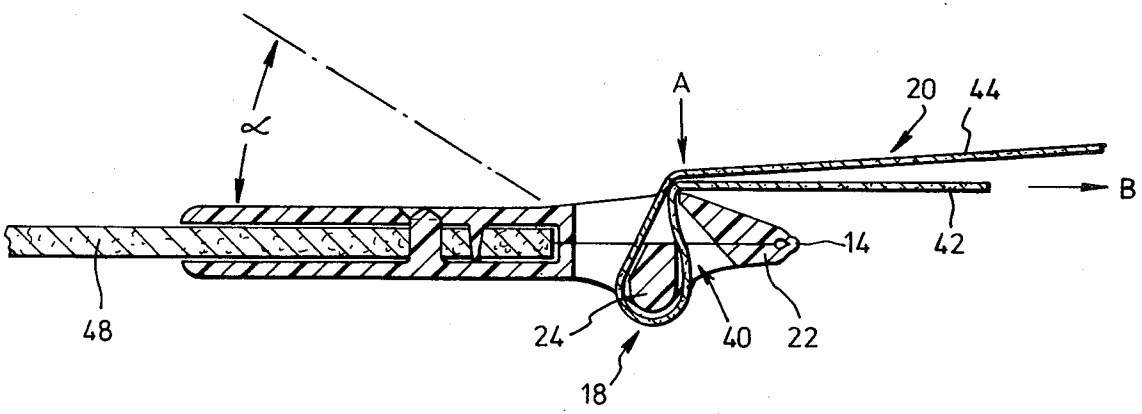
FIG. 3 is a cross-section similar to FIG. 2 but showing the buckle fixed to a workpiece and in its working position with respect to a strap.

The buckle 10 is generally flat in its as-moulded condition (FIGS. 1 and 2) and includes a pair of flaps 12*a*, 12*b* connected by a hinge 14 about which the flaps 12*a*, 12*b* can be folded to a closed position (FIG. 3).

First portions 16*a*, 16*b* of the flaps 12*a*, 12*b* by the hinge 14 are both slotted so that only when the flaps 12*a*, 12*b* are in their closed position is a parallel bar arrangement 18 presented for use in adjustably securing a strap 20.

The parallel bar arrangement 18 can take any conventional form and thus need not be described in detail.

The preferred form, however, is very closely based on that disclosed and claimed in said British patent publication No. 2 020 729A in the name of our parent company Illinois Tool Works Inc. That particular parallel bar arrangement 18 presents a first bar 22 which is parallel to and spaced from a second bar 24. Both of the bars 22, 24 are themselves parallel to the hinge 14 but transverse to the length of the strap 20 to be adjustably secured thereby.

The first bar 22 is formed by parts of both of the first regions 16*a*, 16*b*, whereas the second bar 24 is formed entirely by a part of the first region 16*b*.

The first region 16*a* presents an outer surface 26 which is joined, by an intermediate chamfering surface 28, to a surface 30*a* lying at an acute angle to the surface 26, the surface 30*a* being continued by a surface 30*b* of the first region 16*b*, in the closed position of the flaps 12*a*, 12*b*, to help form the first bar 22.

The first region 16*b* presents an outer curved surface 32 joined at one side to a surface 34 facing the surface 30*b* and at its other side to a surface 36, the surfaces 34 and 36 being themselves joined by a substantially flat surface 38 to fully form the second bar 24.

The first bar 22 is spaced from the second bar 24 by a gap 40 which, when viewed in the direction of arrow A substantially perpendicularly to the parallel bar arrangement 18, appears to be narrower than the thickness of the strap 20, and may be completely closed, so that the strap 20 is caused to be reversely inclined.

If the strap 20 is threaded around the parallel bar arrangement 18 in the manner discussed hereinabove, and as illustrated in FIG. 3, it is found that pulling the free end 42 of the strap 20 in the direction of arrow B to tighten the strap 20 is relatively easy, whereas pulling portion 44 of the strap in the direction of arrow B to loosen the strap 20 is relatively difficult, release of the strap 20 only being possible when the buckle 10 has been positively moved from its illustrated working position through an angle $\alpha$ to its releasing position.

Second regions 46*a*, 46*b* of the flaps 12*a*, 12*b* are further from the hinge 14 than the first regions 16*a*, 16*b* and are for use in trapping therebetween a sheet of fabric 48, or other web-like material. Central areas of the second regions 46*a*, 46*b* are relieved to form, in effect, peripheral ribs 50*a*, 50*b*. The relieved central area of the second region 46*a* is formed with three apertures 52, each of which is itself located centrally of three symmetrically-distributed groups of relatively short spikes 54. The relieved central area of the second region 46*b* is formed with three relatively long spikes 56 which locate within respective ones of the apertures 52 in the closed position of the flaps 12*a*, 12*b*. It will be appreciated that, in the closed position of the flaps 12*a*, 12*b*, the total of 12 spikes 54, 56 act as gripping means to prevent withdrawal of the sheet of fabric 48.

The buckle 10 is firmly ultrasonically welded, in the condition illustrated in FIG. 3, so that the longer spikes 56 and the edges of the apertures 52 fuse together. However, substantially flat surfaces 58*a*, 58*b* of the first regions 16*a*, 16*b*, and those parts of the peripheral ribs 50*a*, 50*b* of the second regions 46*a*, 46*b* which touch one another, may also fuse together.

We claim:

1. In combination with a workpiece, and a wrapable strap member, said strap member having a free-end portion, an improved buckle, said improved buckle being readily fixedly securable to said workpiece, said strap member being adjustably securable to said improved buckle, said improved buckle comprising: a one-piece plastic member, said one-piece member including a first flap and a second flap integral through a resilient hinge with said first flap; said first and second flaps including means for clinching said workpiece engaged therebetween, said workpiece-clinching means being in distal relation to said hinge, for readily fixedly securing said buckle to said workpiece; said first and second flaps including bar means having a first bar and a second bar for adjustably securing said strap member to said buckle, said bar means being proximate to said hinge in relation to said workpiece-clinching means, said strap member extending in one direction from said buckle and said free-end portion being wrapable around said first bar and then directable back in said one direction between said second bar and the remainder of said strap member for causing said free-end portion of said strap member engaging said second bar to be secured to said buckle and for pulling said flaps around said hinge and against said workpiece engaged therebetween, said buckle when fixedly secured to said workpiece being rotatable about the axis of said first bar for disengaging said strap member from said second bar thereby permitting adjustment of said strap member secured to said buckle.

2. The improved buckle of claim 1, wherein: said workpiece-clinching means comprises: at least one of said first and second flaps having a plurality of spikes for piercing said workpiece, the other of said flaps having a plurality of complementary apertures, each one of said apertures being located such that each aperture receives a respective spike when said flaps are urged into engagement with said workpiece positioned intermediate said spikes and said apertures thereby causing said spikes to pierce said workpiece, at least one of said apertures including means for securing said respective spike received therein.

3. The improved buckle of claim 1, wherein: said first and second bars are spaced from each other relative to said workpiece-clinching means and said hinge such that said free-end portion of said strap member wrapped around said first bar and interposed intermediate said second bar and said strap member is urgeable against said second bar by a predetermined force imposed upon said free-end portion of said strap member drawing said free-end portion in a direction such that said free-end portion is relatively closer to said hinge than to said workpiece-clinching means, for securing said strap member to said buckle.

4. The improved buckle of claim 2, wherein: said first and second bars are spaced from each other relative to said workpiece-clinching means and said hinge such that said free-end portion of said strap member wrapped around said first bar and interposed intermediate said second bar and said strap member is urgeable against said second bar by a predetermined force imposed upon said free-end portion of said strap member drawing said free-end portion in a direction such that said free-end portion is relatively closer to said hinge than to said workpiece-clinching means, for securing said strap member to said buckle.

* * * * *